US012111119B2

(12) United States Patent
Palojoki

(10) Patent No.: US 12,111,119 B2
(45) Date of Patent: Oct. 8, 2024

(54) HEAT EXCHANGER, COOLED DEVICE ASSEMBLY COMPRISING THE HEAT EXCHANGER, AND METHOD FOR MANUFACTURING THE HEAT EXCHANGER

(71) Applicant: ABB Schweiz AG, Baden (CH)

(72) Inventor: Vesa Palojoki, Helsinki (FI)

(73) Assignee: ABB Schweiz AG, Baden (CH)

( * ) Notice: Subject to any disclaimer, the term of this patent is extended or adjusted under 35 U.S.C. 154(b) by 30 days.

(21) Appl. No.: 17/809,571

(22) Filed: Jun. 29, 2022

(65) Prior Publication Data

US 2022/0412661 A1 Dec. 29, 2022

(30) Foreign Application Priority Data

Jun. 29, 2021 (EP) ..... 21182270

(51) Int. Cl.
*F28D 9/00* (2006.01)
*F28F 3/00* (2006.01)

(52) U.S. Cl.
CPC ..... *F28D 9/0025* (2013.01); *F28F 3/005* (2013.01); *F28F 2225/06* (2013.01); *F28F 2230/00* (2013.01)

(58) Field of Classification Search
CPC .... F28F 3/005; F28F 2225/06; F28F 2230/00; F28D 9/0025
See application file for complete search history.

(56) References Cited

U.S. PATENT DOCUMENTS 3,200,848 A * 8/1965 Takagi ..... F28F 1/40 138/38
5,107,575 A * 4/1992 Ishida ..... F28D 1/0477 165/184
5,282,507 A * 2/1994 Tongu ..... F25B 15/02 62/495

(Continued)

FOREIGN PATENT DOCUMENTS

CN 1742189 A 3/2006
DE 10302948 A1 * 8/2004 ..... F28D 9/0025

(Continued)

OTHER PUBLICATIONS

Translation of Korean Patent KR100866389B1 entitled Translation—KR100866389B1 (Year: 2023).*

(Continued)

*Primary Examiner* — Paul Alvare
(74) *Attorney, Agent, or Firm* — Whitmyer IP Group LLC

(57) ABSTRACT

A heat exchanger including a corrugated heat transfer sheet having a first surface and a second surface on opposite sides thereof, a first flow channel for a first fluid flow in a first flow direction parallel to a longitudinal direction, and a second flow channel for a second fluid flow in a second flow direction parallel to the longitudinal direction, the second flow direction being opposite to the first flow direction. The heat exchanger includes a channel dividing system which provides the first flow channel and the second flow channel on opposite sides of the corrugated heat transfer sheet such that the first fluid flow is adapted to be in contact with the first surface, and the second fluid flow is adapted to be in contact with the second surface.

20 Claims, 3 Drawing Sheets

(56) References Cited

U.S. PATENT DOCUMENTS

| | | | | |
|---|---|---|---|---|
| 7,591,301 | B2 * | 9/2009 | Whittenberger | B01J 35/04 165/165 |
| 7,594,326 | B2 * | 9/2009 | Whittenberger | B21D 53/04 165/157 |
| 7,661,415 | B2 * | 2/2010 | Nakamura | F02M 26/26 60/605.2 |
| 7,669,645 | B2 * | 3/2010 | Nakamura | F28D 9/0025 165/157 |
| 2004/0031589 | A1 * | 2/2004 | Lin | H01L 23/467 165/185 |
| 2005/0199380 | A1 * | 9/2005 | Thyrum | F28F 3/025 165/165 |
| 2006/0048926 | A1 * | 3/2006 | Richter | F28F 9/02 165/165 |
| 2007/0261837 | A1 * | 11/2007 | Valensa | F28F 3/025 29/890.039 |
| 2008/0072425 | A1 * | 3/2008 | Whittenberger | F28D 9/0025 29/890.03 |
| 2021/0285731 | A1 * | 9/2021 | Lin | F28F 3/12 |
| 2022/0412661 | A1 * | 12/2022 | Palojoki | F28F 3/005 |

FOREIGN PATENT DOCUMENTS

| | | | | |
|---|---|---|---|---|
| KR | 100866389 | B1 * | 10/2008 | |
| WO | WO-2009048458 | A1 * | 4/2009 | B01J 19/2485 |

OTHER PUBLICATIONS

European Search Report; Application No. EP 21 18 2270; Issued: Nov. 17, 2021; 2 Pages.

* cited by examiner

HEAT EXCHANGER, COOLED DEVICE ASSEMBLY COMPRISING THE HEAT EXCHANGER, AND METHOD FOR MANUFACTURING THE HEAT EXCHANGER

TECHNICAL FIELD

The present invention relates to a heat exchanger, a cooled device assembly comprising the heat exchanger, and a method for manufacturing the heat exchanger.

BACKGROUND

Heat exchangers comprising corrugated heat transfer sheets are known in the art.

One of the disadvantages associated with known heat exchangers comprising corrugated heat transfer sheets is that they are complex to manufacture.

Examples of known heat exchangers are described in publications US2007/261837, US2008/072425, US2005/199380 and CN1742189.

SUMMARY

An object of the present invention is to provide a heat exchanger, a cooled device assembly comprising the heat exchanger, and a method for manufacturing the heat exchanger so as to alleviate the above disadvantage. The objects of the invention are achieved by a heat exchanger, a cooled device assembly comprising the heat exchanger, and a method for manufacturing the heat exchanger described in the following.

In the first aspect of the invention, a heat exchanger is provided. The heat exchanger comprises a corrugated heat transfer sheet having a first surface and a second surface on opposite sides thereof, the corrugated heat transfer sheet comprising a plurality of ridges and grooves which alternate in a width direction, and have crests and troughs spaced apart in a depth direction, wherein the width direction, the depth direction and a longitudinal direction are mutually perpendicular directions; a first flow channel for a first fluid flow in a first flow direction parallel to the longitudinal direction; a second flow channel for a second fluid flow in a second flow direction parallel to the longitudinal direction, the second flow direction being opposite to the first flow direction, and a channel dividing system which provides the first flow channel and the second flow channel on opposite sides of the corrugated heat transfer sheet such that the first fluid flow is adapted to be in contact with the first surface, and the second fluid flow is adapted to be in contact with the second surface, wherein the channel dividing system comprises a first channel dividing element and a second channel dividing element spaced apart in the longitudinal direction, the first channel dividing element and the second channel dividing element having first blocking portions adapted to block top portions of the ridges, and second blocking portions adapted to block bottom portions of the grooves, wherein dimensions of the first blocking portions and second blocking portions in the longitudinal direction are less than or equal to 10% of a dimension of the corrugated heat transfer sheet in the longitudinal direction.

In the second aspect of the invention, a cooled device assembly is provided. The cooled device assembly comprises a body part; an outer casing defining a device space inside thereof; the heat exchanger according to the first aspect of the invention, wherein the heat exchanger is connected to the body part, and is accommodated inside the outer casing, and wherein the outer casing partially defines the first flow channel and/or the second flow channel.

In the third aspect of the invention, a method for manufacturing the heat exchanger according to the first aspect of the invention is provided. The method comprises providing an elongated piece of sheet material; folding the elongated piece of sheet material into the form of the corrugated heat transfer sheet;

providing the channel dividing system; and combining the corrugated heat transfer sheet and the channel dividing system.

The invention is based on the idea of providing a first flow channel and a second flow channel on opposite sides of a corrugated heat transfer sheet by means of a channel dividing system, wherein a first fluid flow is adapted to be in contact with a first surface of the corrugated heat transfer sheet, and a second fluid flow is adapted to be in contact with a second surface of the corrugated heat transfer sheet.

An advantage of the heat exchanger of the invention is a simple and inexpensive structure thereof. The cooled device assembly of the invention has the same advantage as the heat exchanger of the invention. An advantage of the method of the invention is that forming a corrugated heat transfer sheet from a sheet material simplifies manufacturing of the heat exchanger.

BRIEF DESCRIPTION OF THE DRAWINGS

In the following the invention will be described in greater detail by means of preferred embodiments with reference to the attached drawings, in which.

DETAILED DESCRIPTION

Figure 1:
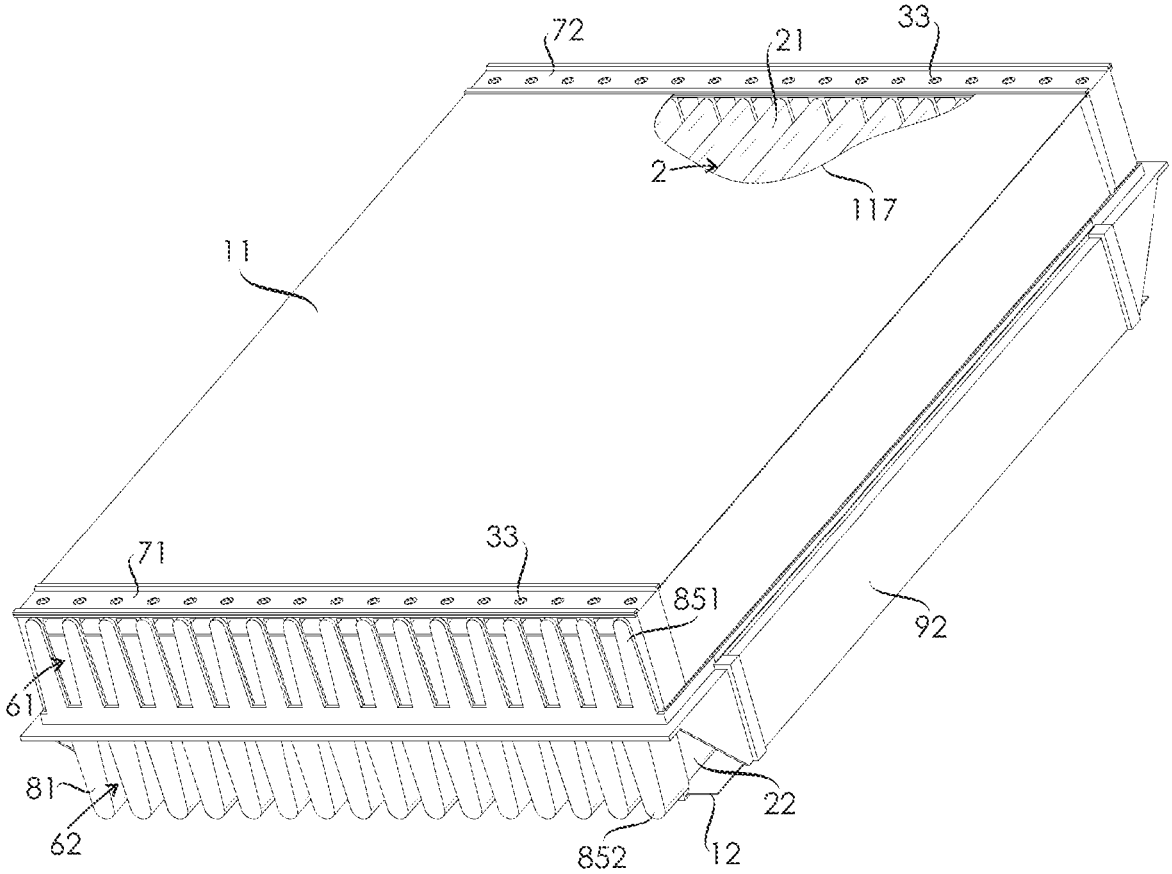
FIG. 1 shows a heat exchanger according to an embodiment of the invention.
Figure 2:
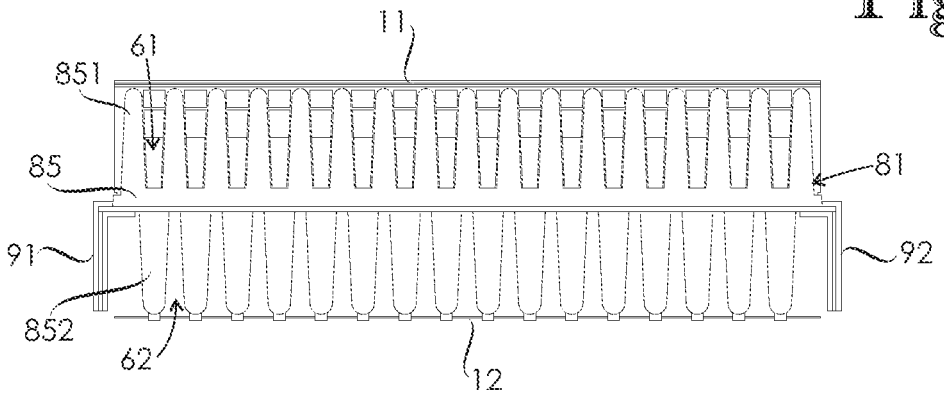
FIG. 2 shows the heat exchanger of FIG. 1 from a direction parallel to a longitudinal direction of the heat exchanger.
Figure 3:
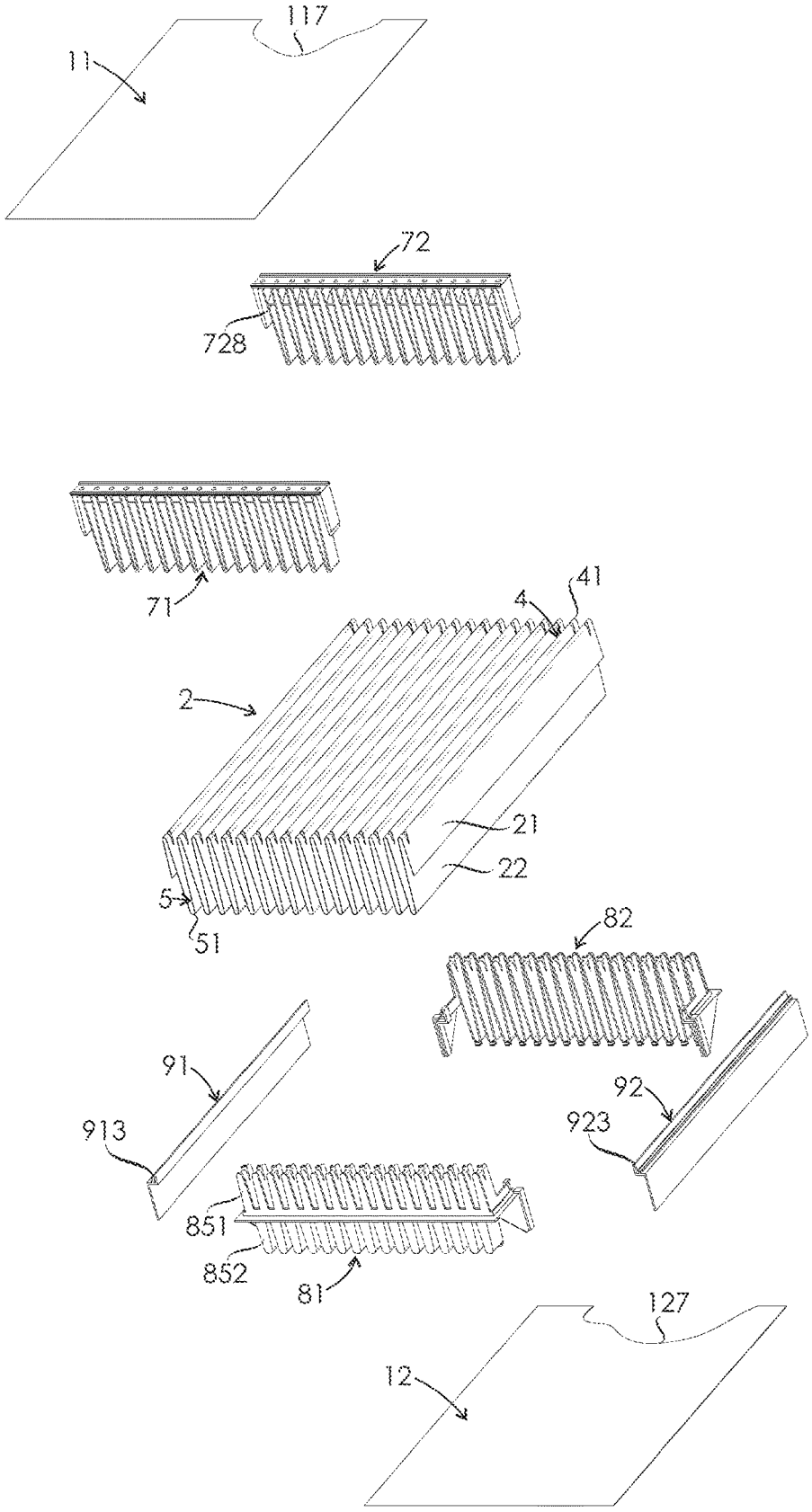
FIG. 3 shows an exploded view of the heat exchanger of FIG. 1.
Figure 4:
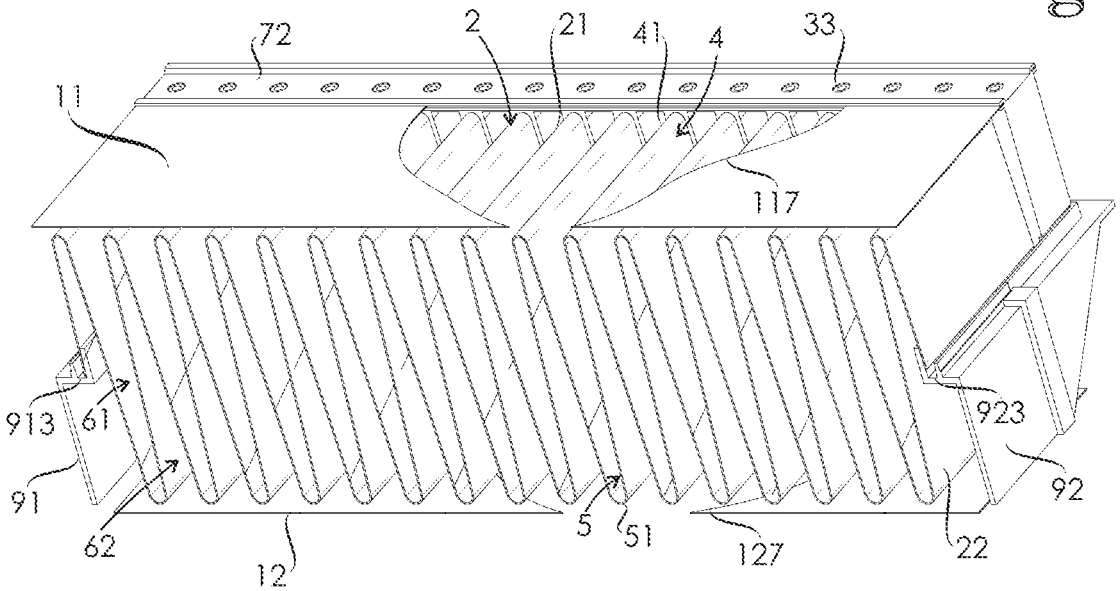
FIG. 4 shows a cut off portion of the heat exchanger of FIG. 1 for exhibiting an internal structure of the heat exchanger.

FIG. 1 shows a heat exchanger according to an embodiment of the invention, the heat exchanger comprising a corrugated heat transfer sheet 2, a channel dividing system, sealing means, and longitudinal support means. FIG. 2 shows the heat exchanger of FIG. 1 form a direction parallel to a longitudinal direction of the heat exchanger. FIG. 3 shows an exploded view of the heat exchanger of FIG. 1. FIG. 4 shows a cut off portion of the heat exchanger of FIG. 1 for exhibiting an internal structure of the heat exchanger.

The corrugated heat transfer sheet 2 has a first surface 21 and a second surface 22 on opposite sides thereof. Referring to FIGS. 3 and 4, the corrugated heat transfer sheet 2 comprises a plurality of ridges 4 and grooves 5 which alternate in a width direction and have crests 41 and troughs 51 spaced apart in a depth direction. The ridges 4 and grooves 5 extend in a longitudinal direction. The width direction, the depth direction and the longitudinal direction are mutually perpendicular directions.

Herein, the crests 41 are peaks of the ridges 4, and troughs 51 are bottoms of the grooves 5 such that the crests 41 and the troughs 51 are extreme portions of the corrugated heat transfer sheet 2 in the depth direction. In FIG. 2, the longitudinal direction is perpendicular to the image plane, the depth direction is vertical, and the width direction is horizontal.

A thickness of the corrugated heat transfer sheet 2 is 0.25 mm. In an alternative embodiment, a thickness of the corrugated heat transfer sheet is less than or equal to 1 mm.

The corrugated heat transfer sheet 2 is made of steel. In an alternative embodiment, the corrugated heat transfer sheet is made of another metal such as aluminium. Since the corrugated heat transfer sheet is thin, temperature difference between the first surface and second surface is small even if the corrugated heat transfer sheet is made of a material having only moderate thermal conductivity. Therefore, in a further alternative embodiment, the corrugated heat transfer sheet is made of plastic such as polypropylene or polycarbonate. In a yet further alternative embodiment, the corrugated heat transfer sheet is made of graphene.

The channel dividing system provides a first flow channel 61 and a second flow channel 62 on opposite sides of the corrugated heat transfer sheet 2. The first flow channel 61 is adapted for a first fluid flow in a first flow direction parallel to the longitudinal direction. The first fluid flow is adapted to be in contact with the first surface 21. The second flow channel 62 is adapted for a second fluid flow in a second flow direction parallel to the longitudinal direction, the second flow direction being opposite to the first flow direction. The second fluid flow is adapted to be in contact with the second surface 22. The heat exchanger is adapted to transfer heat between the first fluid flow and the second fluid flow.

In FIG. 2, a direction of the first fluid flow is towards the viewer, and a direction of the second fluid flow is away from the viewer. The directions of the fluid flows have significance due to flow deflectors discussed later on.

If accidental leaks are ignored, the first fluid flow is not adapted to be in contact with the second surface 22 at all. Similarly, if accidental leaks are ignored, the second fluid flow is not adapted to be in contact with the first surface 21 at all.

The heat exchanger comprises a top wall 11 adjacent the crests 41 of the corrugated heat transfer sheet 2, and a bottom wall 12 adjacent troughs 51 of the corrugated heat transfer sheet 2. The top wall 11 and the bottom wall 12 are planar walls spaced apart from each other in the depth direction. The top wall 11 and the bottom wall 12 are parallel to each other. Normals of the top wall 11 and the bottom wall 12 are parallel to the depth direction.

In the depth direction, the first flow channel 61 is limited by the first surface 21 and the top wall 11, and the second flow channel 62 is limited by the second surface 22 and the bottom wall 12. In FIGS. 1, 3, 4 and 5, the top wall 11 is provided with a top wall aperture 117, and in FIGS. 3 and 4, the bottom wall 12 is provided with a bottom wall aperture 127. The top wall aperture 117 and the bottom wall aperture 127 are additional apertures added to the Figures in order to better show the corrugated heat transfer sheet 2. The top wall aperture 117 and the bottom wall aperture 127 are not present in the actual heat exchanger.

The first fluid flow and the second fluid flow are air flows. In alternative embodiments the first fluid flow and the second fluid flow are different type of gas flows or liquid flows.

The channel dividing system comprises a first channel dividing element 81 and a second channel dividing element 82 spaced apart in the longitudinal direction. The first channel dividing element 81 is located at a first longitudinal end of the corrugated heat transfer sheet 2, and the second channel dividing element 82 is located at a second longitudinal end of the corrugated heat transfer sheet 2.

The first channel dividing element 81 and the second channel dividing element 82 have first blocking portions 851 adapted to block top portions of the ridges 4, and second blocking portions 852 adapted to block bottom portions of the grooves 5. The first blocking portions 851 and the second blocking portions 852 protrude from a body part 85 of channel dividing element. The first blocking portions 851 protrude in the direction of the ridges 4, and the second blocking portions 852 protrude in the direction of the grooves 5. In FIG. 2, the first blocking portions 851 protrude upwards from the body part 85, and the second blocking portions 852 protrude downwards from the body part 85. Dimensions of the first blocking portions 851 and second blocking portions 852 in the longitudinal direction are less than 10% of a dimension of the corrugated heat transfer sheet 2 in the longitudinal direction.

On a first side of the body part 85, the first blocking portions 851 prevent a fluid flow from getting into contact with the second surface 22 of the corrugated heat transfer sheet 2. On a second side of the body part 85, the second blocking portions 852 prevent a fluid flow from getting into contact with the first surface 21 of the corrugated heat transfer sheet 2. In FIG. 2, the first side of the body part 85 is above the body part 85, and the second side of the body part 85 is below the body part 85.

There is a division plane such that the first flow channel 61 is located on one side of the division plane, and the second flow channel 62 is located on the other side of the division plane. A distance between the division plane and the crests 41 is equal to a distance between the division plane and the troughs 51. The longitudinal direction and the width direction are parallel to the division plane.

Since dimensions of the first blocking portions 851 and second blocking portions 852 in the longitudinal direction are small compared to a longitudinal dimension of the corrugated heat transfer sheet 2, the first blocking portions 851 allow the second fluid flow to flow in a majority of length of top portions of the ridges 4, and the second blocking portions 852 allow the first fluid flow to flow in a majority of length of bottom portions of the grooves 5. Consequently, the first fluid flow is adapted to be in contact with approximately 90% of an area of the first surface 21, and the second fluid flow is adapted to be in contact with approximately 90% of an area of the second surface 22. In an alternative embodiment, the first fluid flow is adapted to be in contact with at least 75% of an area of the first surface, and the second fluid flow is adapted to be in contact with at least 75% of an area of the second surface.

The first channel dividing element 81 and the second channel dividing element 82 support the corrugated heat transfer sheet 2 for maintaining the corrugated heat transfer sheet 2 in its correct corrugated shape. This supporting function of the first channel dividing element and the second channel dividing element enables manufacturing the corrugated heat transfer sheet of thin sheet material.

The sealing means provide sealing between the corrugated heat transfer sheet 2 and the channel dividing system, thereby improving separation between the first flow channel 61 and the second flow channel 62. Consequently, the sealing means provide sealing, inter alia, between the corrugated heat transfer sheet 2 and the first channel dividing element 81, and between the corrugated heat transfer sheet 2 and the second channel dividing element 82.

The sealing means prevent dust and water from transferring between the first flow channel 61 and the second flow channel 62. In an embodiment, a level of ingress protection is IP55.

The sealing means comprises a first end support element 71, a second end support element 72, a first side support element 91, and a second side support element 92. The first end support element 71 co-operates with the first channel dividing element 81 for sealing the corrugated heat transfer sheet 2 against the first channel dividing element 81. The first longitudinal end of the corrugated heat transfer sheet 2 is located between the first end support element 71 and the first channel dividing element 81 in the depth direction, and the first end support element 71 presses the corrugated heat transfer sheet 2 against the first channel dividing element 81 in the depth direction. The second longitudinal end of the corrugated heat transfer sheet 2 is located between the second end support element 72 and the second channel dividing element 82 in the depth direction, and the second end support element 72 presses the corrugated heat transfer sheet 2 against the second channel dividing element 82 in the depth direction.

The first end support element 71 and the second end support element 72 have contact surfaces whose shapes correspond to a shape of the corrugated heat transfer sheet 2 such that a contact area between the first end support element 71 and the corrugated heat transfer sheet 2 is large, and a contact area between the second end support element 72 and the corrugated heat transfer sheet 2 is large. Consequently, the contact surfaces of the first end support element 71 and the second end support element 72 have corrugated shapes.

The first end support element 71 and the second end support element 72 each comprises a flow deflector adapted to deflect corresponding fluid flow towards the corrugated heat transfer sheet 2 in order to improve heat transfer between the fluid flow and the corrugated heat transfer sheet 2. In FIG. 3, a flow deflector of the second end support element 72 is denoted with a reference number 728.

Dimensions of the first end support element 71 and the second end support element 72 in the longitudinal direction are less than 10% of a dimension of the corrugated heat transfer sheet 2 in the longitudinal direction. In an alternative embodiment, dimensions of the first end support element and the second end support element in the longitudinal direction are less than or equal to 20% of a dimension of the corrugated heat transfer sheet in the longitudinal direction.

In an alternative embodiment, the heat exchanger does not comprise any end support elements. For example, if connections between the corrugated heat transfer sheet and the first and second channel dividing elements are firm and tight enough by themselves, there might not be need for any end support elements. The first side support element 91 and the second side support element 92 extend in the longitudinal direction and are spaced apart in the width direction. The first side support element 91 is located on the first lateral side of the corrugated heat transfer sheet 2, and supports the corrugated heat transfer sheet 2 in a first lateral direction parallel to the width direction. The second side support element 92 is located on a second lateral side of the corrugated heat transfer sheet 2, and supports the corrugated heat transfer sheet 2 in a second lateral direction opposite to the first lateral direction. The first side support element 91 takes part in sealing a first side edge of the corrugated heat transfer sheet 2, and the second side support element 92 takes part in sealing a second side edge of the corrugated heat transfer sheet 2.

The first channel dividing element 81, the second channel dividing element 82, the first end support element 71, the second end support element 72, the first side support element 91, and the second side support element 92 are made of plastic by injection moulding.

The first side support element 91 comprises a first support groove 913 extending in the longitudinal direction. The first side edge of the corrugated heat transfer sheet 2 is received in the first support groove 913. The second side support element 92 comprises a second support groove 923 extending in the longitudinal direction. The second side edge of the corrugated heat transfer sheet 2 is received in the second support groove 923.

In an embodiment, there is sealing compound in the first support groove and second support groove for improving sealing between the corrugated heat transfer sheet and the side support elements. Further, it is possible to use sealing compound also between the corrugated heat transfer sheet and the channel dividing elements.

The longitudinal support means are adapted for preventing relative movement in the longitudinal direction between the first channel dividing element 81 and the corrugated heat transfer sheet 2, and between the second channel dividing element 82 and the corrugated heat transfer sheet 2. The longitudinal support means comprises a plurality of screws 33 connecting the corrugated heat transfer sheet 2 to the first end support element 71 and the first channel dividing element 81, and to the second end support element 72 and the second channel dividing element 82.

A first set of screws 33 passes through the first end support element 71 and the corrugated heat transfer sheet 2 to the first channel dividing element 81. A second set of screws 33 passes through the second end support element 72 and the corrugated heat transfer sheet 2 to the second channel dividing element 82. The screws 33 are shown in FIGS. 1 and 4.

It should be noted that also the longitudinal support means takes part in providing sealing between the corrugated heat transfer sheet 2 and the channel dividing system. The plurality of screws connecting the corrugated heat transfer sheet 2 to the channel dividing elements 81 and 82 press the corrugated heat transfer sheet 2 against the channel dividing element. In embodiments where there is adhesive between the corrugated heat transfer sheet and the channel dividing elements, the adhesive functions both as longitudinal support means and sealing means. Therefore, in many embodiments it is not possible to clearly divide structures in sealing means and longitudinal support means.

The first channel dividing element 81, the second channel dividing element 82, the first side support element 91 and the second side support element 92 are connected together such that they form a heat exchanger frame which supports the corrugated heat transfer sheet 2 from all four sides thereof, and is adapted for connecting the heat exchanger to a body part of a cooled device assembly.

In an alternative embodiment, the heat exchanger comprises an intermediate support element adapted to support the corrugated heat transfer sheet between the first channel dividing element and the second channel dividing element. The intermediate support element is located between the first channel dividing element and the second channel dividing element in the longitudinal direction. The intermediate support element is in contact with the corrugated heat transfer sheet in order to brace the corrugated heat transfer sheet. The intermediate support element is also adapted to increase turbulence in the first fluid flow and/or the second fluid flow.

Figure 5:
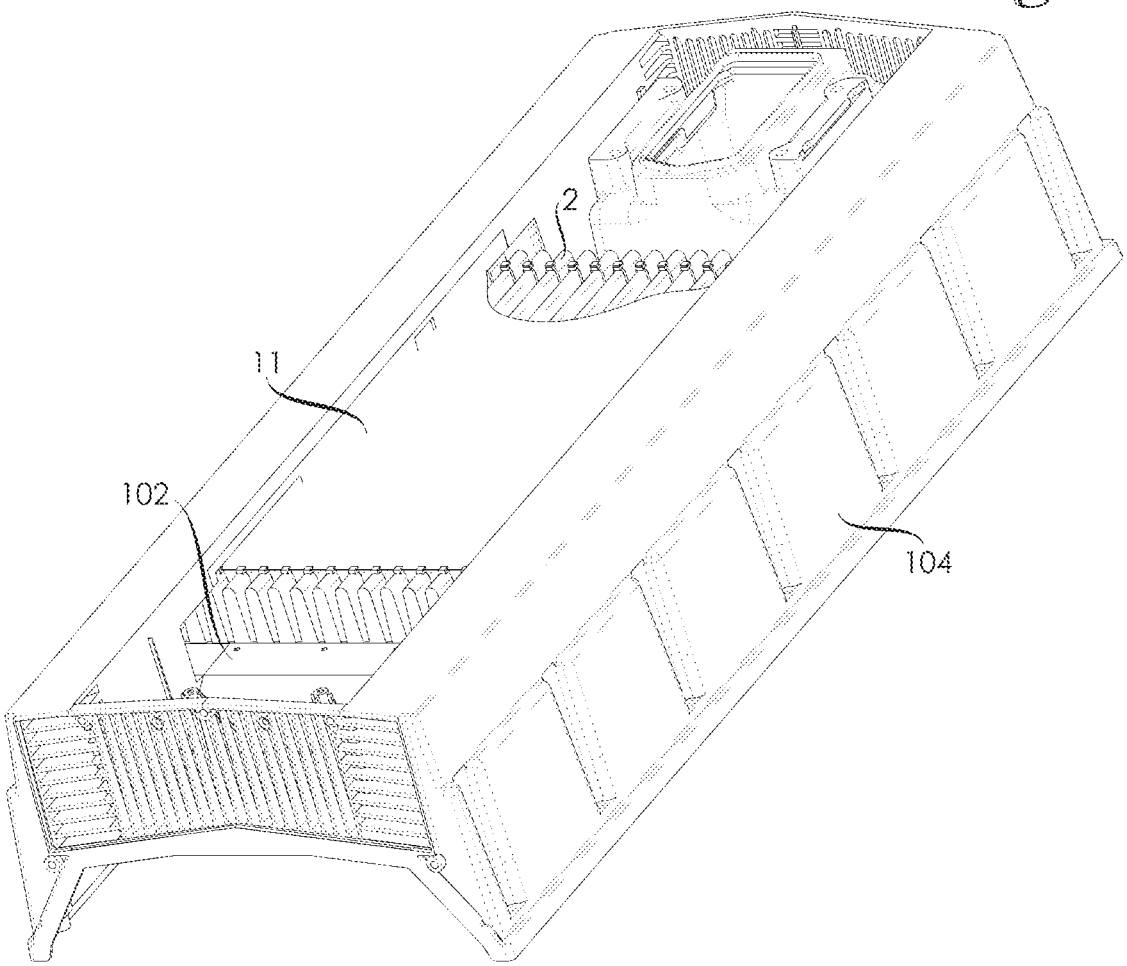
FIG. 5 shows a cooled device assembly comprising the heat exchanger of FIG. 1.

FIG. 5 shows a cooled device assembly comprising a body part 102, an outer casing 104 defining a device space inside thereof, and the heat exchanger of FIG. 1. The heat exchanger is mechanically connected to the body part 102, and is accommodated inside the outer casing 104.

In alternative embodiments, the outer casing and/or the body part of the cooled device assembly form parts of the heat exchanger. For example, in an embodiment, the heat exchanger does not comprise a top wall or a bottom wall but is the first flow channel and the second flow channel are limited in the depth direction by portions of the outer casing of the cooled device assembly. Further, in another embodiment, at least one of the following components is an integral part of the body part of the cooled device assembly: the first channel dividing element, the second channel dividing element, the first side support element, and the second side support element. It is possible to form said at least one integral component by the same injection moulding process as the body part of the cooled device assembly.

In FIG. 5, several parts of the cooled device assembly have been omitted. The omitted parts comprise an electrical device requiring cooling, and a user interface. In an embodiment, the electrical device requiring cooling is a converter device such as a frequency converter.

A method for manufacturing the heat exchanger of FIG. 1 comprises providing an elongated piece of sheet material, folding the elongated piece of sheet material into the form of the corrugated heat transfer sheet 2, providing the channel dividing system, and combining the corrugated heat transfer sheet 2 and the channel dividing system. Said combining comprises pushing the corrugated heat transfer sheet 2 in the depth direction relative to the first channel dividing element 81 and the second channel dividing element 82 until the corrugated heat transfer sheet 2 is in contact with the first 81 and second 82 channel dividing elements. In an embodiment, the sheet material is supplied to the manufacturing process from a roll.

In an embodiment, the folding process comprises forming a plurality of creases into the elongated piece of sheet material. Subsequently, the elongated piece of sheet material is folded into the form of the corrugated heat transfer sheet along the plurality of creases. In an alternative embodiment, the manufacturing method does not comprise forming creases into the elongated piece of sheet material.

The channel dividing system is made of different material, and with different manufacturing process than the corrugated heat transfer sheet. In an embodiment, the first channel dividing element, the second channel dividing element, the first end support element, the second end support element, the first side support element, and the second side support element are manufactured at one location, and are transported to a second location at which the corrugated heat transfer sheet is formed by folding an elongated piece of sheet material, and the heat exchanger is manufactured.

The heat exchanger of FIG. 1 only has one corrugated heat transfer sheet 2. In an alternative embodiment, the heat exchanger comprises a plurality of corrugated heat transfer sheets wherein the corrugated heat transfer sheets are arranged in a stack such that planes defined by individual sheets are parallel to each other and are spaced apart in the depth direction. The first flow channel and the second flow channel each comprises a plurality of subchannels. The individual corrugated heat transfer sheets are separated from each other by separation plates. In an embodiment, the first and second end support elements, and/or the first and second channel dividing elements are provided with fastening means for fastening the separation plates.

It will be obvious to a person skilled in the art that the inventive concept can be implemented in various ways. The invention and its embodiments are not limited to the examples described above but may vary within the scope of the claims.

The invention claimed is:

1. A heat exchanger comprising:

a corrugated heat transfer sheet having a first surface and a second surface on opposite sides thereof, the corrugated heat transfer sheet comprising a plurality of ridges and grooves which alternate in a width direction, and have crests and troughs spaced apart in a depth direction, wherein the width direction, the depth direction and a longitudinal direction are mutually perpendicular directions;

a first flow channel for a first fluid flow in a first flow direction parallel to the longitudinal direction;

a second flow channel for a second fluid flow in a second flow direction parallel to the longitudinal direction, the second flow direction being opposite to the first flow direction, and a channel dividing system which provides the first flow channel and the second flow channel on opposite sides of the corrugated heat transfer sheet such that the first fluid flow is adapted to be in contact with the first surface, and the second fluid flow is adapted to be in contact with the second surface, wherein the channel dividing system comprises a first channel dividing element and a second channel dividing element spaced apart in the longitudinal direction, the first channel dividing element and the second channel dividing element having first blocking portions adapted to block top portions of the ridges, and second blocking portions adapted to block bottom portions of the grooves, wherein dimensions of the first blocking portions and second blocking portions in the longitudinal direction are less than or equal to 10% of a dimension of the corrugated heat transfer sheet in the longitudinal direction, and where both the first flow channel and the second flow channel comprise an inlet for an inflow and an outlet for an outflow such that both the inflow and the outflow are parallel to the longitudinal direction.

2. The heat exchanger as claimed in claim 1, wherein the channel dividing system comprises longitudinal support means for preventing relative movement in the longitudinal direction between the first channel dividing element and the corrugated heat transfer sheet.

3. The heat exchanger as claimed in claim 2, wherein the longitudinal support means comprises adhesive and/or at least one screw connecting the corrugated heat transfer sheet to the first channel dividing element.

4. The heat exchanger as claimed in claim 1, wherein the heat exchanger comprises sealing means providing sealing between the channel dividing system and the corrugated heat transfer sheet, thereby improving separation between the first flow channel and the second flow channel.

5. A heat exchanger comprising:

a corrugated heat transfer sheet having a first surface and a second surface on opposite sides thereof, the corrugated heat transfer sheet comprising a plurality of ridges and grooves which alternate in a width direction, and have crests and troughs spaced apart in a depth direction, wherein the width direction, the depth direction and a longitudinal direction are mutually perpendicular directions;

a first flow channel for a first fluid flow in a first flow direction parallel to the longitudinal direction;

a second flow channel for a second fluid flow in a second flow direction parallel to the longitudinal direction, the second flow direction being opposite to the first flow direction, and a channel dividing system which provides the first flow channel and the second flow channel on opposite sides of the corrugated heat transfer sheet such that the first fluid flow is adapted to be in contact with the first surface, and the second fluid flow is adapted to be in contact with the second surface, wherein the channel dividing system comprises a first channel dividing element and a second channel dividing element spaced apart in the longitudinal direction, the first channel dividing element and the second channel dividing element having first blocking portions adapted to block top portions of the ridges, and second blocking portions adapted to block bottom portions of the grooves, wherein dimensions of the first blocking portions and second blocking portions in the longitudinal direction are less than or equal to 10% of a dimension of the corrugated heat transfer sheet in the longitudinal direction, wherein the heat exchanger comprises sealing means providing sealing between the channel dividing system and the corrugated heat transfer sheet, thereby improving separation between the first flow channel and the second flow channel, and wherein the sealing means comprises a first end support element co-operating with the first channel dividing element for sealing the corrugated heat transfer sheet against the first channel dividing element, wherein a portion of the corrugated heat transfer sheet is located between the first end support element and the first channel dividing element in the depth direction, and the first end support element presses the portion of corrugated heat transfer sheet against the first channel dividing element in the depth direction.

6. The heat exchanger as claimed in claim 4, wherein the sealing means comprises a second end support element co-operating with the second channel dividing element for sealing the corrugated heat transfer sheet against the second channel dividing element, wherein a portion of the corrugated heat transfer sheet is located between the second end support element and the second channel dividing element in the depth direction, and the second end support element presses the portion of corrugated heat transfer sheet against the second channel dividing element in the depth direction.

7. The heat exchanger as claimed in claim 4, wherein the sealing means comprises a first side support element and a second side support element extending in the longitudinal direction and spaced apart in the width direction, wherein the first side support element takes part in sealing a first side edge of the corrugated heat transfer sheet, and the second side support element takes part in sealing a second side edge of the corrugated heat transfer sheet.

8. The heat exchanger as claimed in claim 7, wherein the first side support element comprises a first support groove extending in the longitudinal direction, the first side edge of the corrugated heat transfer sheet being received in the first support groove, and the second side support element comprises a second support groove extending in the longitudinal direction, the second side edge of the corrugated heat transfer sheet being received in the second support groove.

9. The heat exchanger as claimed in claim 1, wherein a thickness of the corrugated heat transfer sheet is less than or equal to 1 mm.

10. The heat exchanger as claimed in claim 1, wherein the channel dividing system is made of different material than the corrugated heat transfer sheet.

11. A cooled device assembly comprising:

a body part;

an outer casing defining a device space inside thereof;

the heat exchanger as claimed in claim 1, wherein the heat exchanger is connected to the body part, and is accommodated inside the outer casing, and wherein the outer casing partially defines the first flow channel and/or the second flow channel.

12. A method for manufacturing the heat exchanger according to claim 1, the method comprising:

providing an elongated piece of sheet material;

folding the elongated piece of sheet material into the form of the corrugated heat transfer sheet;

providing the channel dividing system; and combining the corrugated heat transfer sheet and the channel dividing system.

13. The method according to claim 12, wherein the method comprises forming a plurality of creases into the elongated piece of sheet material, and the folding of the elongated piece of sheet material into the form of the corrugated heat transfer sheet is made along the plurality of creases.

14. The heat exchanger as claimed in claim 2, wherein the heat exchanger comprises sealing means providing sealing between the channel dividing system and the corrugated heat transfer sheet, thereby improving separation between the first flow channel and the second flow channel.

15. The heat exchanger as claimed in claim 5, wherein the heat exchanger comprises sealing means providing sealing between the channel dividing system and the corrugated heat transfer sheet, thereby improving separation between the first flow channel and the second flow channel.

16. The heat exchanger as claimed in claim 2, wherein a thickness of the corrugated heat transfer sheet is less than or equal to 1 mm.

17. The heat exchanger as claimed in claim 5, wherein a thickness of the corrugated heat transfer sheet is less than or equal to 1 mm.

18. The heat exchanger as claimed in claim 2, wherein the channel dividing system is made of different material than the corrugated heat transfer sheet.

19. The heat exchanger as claimed in claim 5, wherein the channel dividing system is made of different material than the corrugated heat transfer sheet.

20. A heat exchanger comprising a corrugated heat transfer sheet having a first surface and a second surface on opposite sides thereof, the corrugated heat transfer sheet comprising a plurality of ridges and grooves which alternate in a width direction and have crests and troughs spaced apart in a depth direction, wherein the width direction the depth direction and a longitudinal direction are mutually perpendicular directions;

a first flow channel for a first fluid flow in a first flow direction parallel to the longitudinal direction;

a second flow channel for a second fluid flow in a second flow direction parallel to the longitudinal direction, the second flow direction being opposite to the first flow direction, and a channel dividing system which provides the first flow channel and the second flow channel on opposite sides of the corrugated heat transfer sheet such that the first fluid flow is adapted to be in contact with the first surface, and the second fluid flow is adapted to be in contact with the second surface, wherein the channel dividing system comprises a first channel dividing element and a second channel dividing element spaced apart in the longitudinal direction, the first channel dividing element and the second channel dividing element having first blocking portions adapted to block top portions of the ridges, and second blocking portions adapted to block bottom portions of the grooves, wherein dimensions of the first blocking portions and second blocking portions in the longitudinal direction are less than or equal to 10% of a dimension of the corrugated heat transfer sheet in the longitudinal direction, and wherein a length of the first flow channel is equal to a length of the second flow channel.

* * * * *